US011744340B2

(12) United States Patent
Plata

(10) Patent No.: US 11,744,340 B2
(45) Date of Patent: Sep. 5, 2023

(54) ANTI-THEFT REAR MECHANISM WITH A MAGNETIC OPENING SYSTEM AND A SYSTEM OF SELF-ADJUSTING STRAPS, FOR OBJECTS INTENDED TO HOLD ELEMENTS, SUCH AS BRIEFCASES, BACKPACKS OR SUITCASES

(71) Applicant: THE FRENCHIE GROUP S.A.S., Bogota (CO)

(72) Inventor: Camilo Mejia Plata, Bogota (CO)

( * ) Notice: Subject to any disclaimer, the term of this patent is extended or adjusted under 35 U.S.C. 154(b) by 73 days.

(21) Appl. No.: 17/048,628

(22) PCT Filed: Mar. 5, 2019

(86) PCT No.: PCT/CO2019/000003
§ 371 (c)(1),
(2) Date: Oct. 19, 2020

(87) PCT Pub. No.: WO2019/201358
PCT Pub. Date: Oct. 24, 2019

(65) Prior Publication Data

US 2021/0145140 A1 May 20, 2021

(30) Foreign Application Priority Data

Apr. 17, 2018 (CO) ..... NC2018/0004107

(51) Int. Cl.
*A45F 3/04* (2006.01)
*A45C 13/18* (2006.01)
*A45C 13/10* (2006.01)

(52) U.S. Cl.
CPC ..... *A45C 13/18* (2013.01); *A45C 13/1069* (2013.01); *A45F 3/04* (2013.01)

(58) Field of Classification Search
CPC ..... A45C 13/18; A45C 13/1069; A45F 3/04
See application file for complete search history.

(56) References Cited

U.S. PATENT DOCUMENTS 2,197,427 A 4/1940 Roy
4,236,331 A * 12/1980 Mattson ..... A44C 3/001 40/621

(Continued)

FOREIGN PATENT DOCUMENTS

EP 1457131 B1 9/2004
EP 1484996 A1 12/2004

(Continued)

*Primary Examiner* — Jason W San
(74) *Attorney, Agent, or Firm* — Nolan Heimann LLP; Adam Diament

(57) ABSTRACT

The invention relates to a rear protection mechanism with a magnetic opening system, intended for objects used to hold elements, such as, for example, briefcases, backpacks or suitcases, said mechanism acting as an anti-theft system for rear, side and/or lower pockets on said objects. The rear mechanism with a magnetic opening system (positioned against the user's body) consists of flaps with non-visible magnets located inside said flaps, which, upon coming into contact with other magnets located on the rear surface of the object, generate an attraction that secures the flaps, such as to prevent third parties from gaining access to pockets on the outside of the briefcase, backpack or suitcase. The invention also relates to a system of self-adjusting straps that allow the weight or load contained in the element-holding object.

1 Claim, 5 Drawing Sheets

(56) References Cited

U.S. PATENT DOCUMENTS 4,826,059 A * 5/1989 Bosch ..... A45C 11/24 211/DIG. 1
5,515,581 A * 5/1996 Kaufmann ..... A45C 13/1069 24/303
5,657,917 A * 8/1997 Johnson ..... A45F 3/04 224/582
5,682,653 A * 11/1997 Berglof ..... G09F 1/10 224/183
5,779,036 A 7/1998 Westbrook et al.
5,784,763 A * 7/1998 Cassidy ..... F16G 11/14 24/130
6,070,776 A 6/2000 Furnary et al.
6,301,754 B1 * 10/2001 Grunberger ..... A41F 1/002 24/303
6,345,418 B1 * 2/2002 Bertrand ..... B65D 63/16 24/199
6,598,271 B2 * 7/2003 Nire ..... A44B 11/258 24/303
6,606,767 B2 * 8/2003 Wong ..... A41F 1/006 24/303
9,009,931 B2 * 4/2015 Jensen ..... A45C 13/30 24/615
9,307,808 B1 * 4/2016 Lill ..... A44B 99/00
9,339,090 B1 * 5/2016 Renegar ..... G09F 7/04
9,549,580 B2 * 1/2017 Horton ..... A41D 1/18
9,868,268 B2 * 1/2018 Hoffman ..... E04C 2/205
9,913,551 B1 * 3/2018 Baker ..... A47G 9/04
9,914,615 B2 * 3/2018 Wooldridge ..... B65H 75/446
9,966,174 B2 * 5/2018 Naftali ..... A45C 13/1069
10,586,641 B2 * 3/2020 Good ..... H01F 7/0263
10,629,349 B2 * 4/2020 Naftali ..... A45C 13/1069
10,893,714 B2 * 1/2021 Zimmermann ..... A44B 99/00
10,943,514 B1 * 3/2021 O'Keefe ..... G09F 7/10
11,151,908 B2 * 10/2021 Kott ..... G09F 3/20
11,369,175 B2 * 6/2022 McLean ..... F41C 33/06
11,369,463 B1 * 6/2022 Lemchen ..... A61C 19/02
2006/0056743 A1 * 3/2006 Kobetsky ..... B65D 33/2541 24/399
2009/0188592 A1 * 7/2009 Connacher ..... A45C 13/126 150/112
2009/0193690 A1 * 8/2009 Moretti ..... A43B 7/125 36/30 R
2009/0307878 A1 * 12/2009 Kadas ..... A45F 5/02 24/304
2010/0186134 A1 * 7/2010 Hunter ..... B32B 27/12 2/2.5
2010/0275419 A1 * 11/2010 Millus ..... A47G 21/167 24/306
2011/0179608 A1 * 7/2011 Colorado ..... A62B 9/04 24/573.11
2012/0017406 A1 * 1/2012 Colorado ..... A62B 25/00 24/593.1
2012/0067746 A1 * 3/2012 Gremaud ..... G07D 9/002 206/0.81
2012/0128273 A1 * 5/2012 Lytle ..... A45C 3/00 383/59
2012/0216374 A1 * 8/2012 Manuello ..... A41F 1/002 24/303
2012/0262117 A1 * 10/2012 Ferber ..... H02J 7/0048 320/111
2013/0029813 A1 * 1/2013 Hetrick ..... A63B 21/068 482/139
2013/0061431 A1 * 3/2013 Naftali ..... A45C 13/1069 24/303
2014/0274204 A1 * 9/2014 Williams ..... H04B 1/385 455/556.1
2015/0067951 A1 * 3/2015 Johnsen ..... A63B 33/004 2/431
2015/0237217 A1 * 8/2015 Roark ..... A45C 15/00 248/68.1
2015/0289629 A1 * 10/2015 Nakamura ..... A45C 13/08 24/3.1
2015/0342273 A1 * 12/2015 English ..... A41D 17/005 36/1.5
2015/0342325 A1 * 12/2015 Wright ..... A45F 3/04 224/642
2016/0186789 A1 * 6/2016 Nelson ..... F16B 1/00 24/303
2016/0307680 A1 * 10/2016 Provencher ..... A45C 13/1069
2017/0020270 A1 * 1/2017 Pactanac ..... A45F 3/04
2018/0055199 A1 3/2018 Eberle
2018/0084091 A1 * 3/2018 Williams ..... H04M 1/0249
2018/0146759 A1 * 5/2018 Godshaw ..... A45C 13/18
2018/0323818 A1 * 11/2018 Hill ..... H04B 1/3888
2019/0090390 A1 * 3/2019 Judy ..... A45C 13/1069
2019/0090616 A1 * 3/2019 Price ..... A63C 17/01
2019/0133303 A1 * 5/2019 Thiel ..... H01M 50/256
2019/0142113 A1 * 5/2019 Prugue ..... A44B 11/18 24/200
2019/0183423 A1 * 6/2019 Radivojevic ..... A61B 5/6831
2019/0223579 A1 * 7/2019 Postolek ..... A45F 3/04
2019/0298027 A1 * 10/2019 Schurman ..... A45C 7/0086
2020/0015560 A1 * 1/2020 Godshaw ..... A45C 3/06
2020/0046099 A1 * 2/2020 Wang ..... A45C 13/18
2020/0170362 A1 * 6/2020 Xie ..... A45C 13/08
2020/0196740 A1 * 6/2020 Hassett ..... A45F 3/04
2021/0145140 A1 * 5/2021 Plata ..... A45F 3/047
2021/0267322 A1 * 9/2021 Wu ..... A44B 19/305
2021/0315363 A1 * 10/2021 Krulik ..... A61L 2/26
2022/0192334 A1 * 6/2022 Ratigan ..... A63B 29/02
2022/0232953 A1 * 7/2022 Errafi ..... A45F 3/12

FOREIGN PATENT DOCUMENTS

EP 1902646 A1 3/2008
WO 0110260 A1 2/2001
WO WO-2018055199 A1 * 3/2018 ..... A61K 31/485

* cited by examiner

ANTI-THEFT REAR MECHANISM WITH A MAGNETIC OPENING SYSTEM AND A SYSTEM OF SELF-ADJUSTING STRAPS, FOR OBJECTS INTENDED TO HOLD ELEMENTS, SUCH AS BRIEFCASES, BACKPACKS OR SUITCASES

SUMMARY

It may be described as (i) a rear protection mechanism with magnetic opening for items intended for storage such as briefcases, backpacks or suitcases, which acts as an anti-theft system for rear, side and/or lower pockets. The rear magnetic opening mechanism (located against the user's body) is made up of flaps with non-visible magnets located inside them, which, at contact with other magnets located on the rear face of the object, generate an attraction effect that secures the flaps in such a way that it prevents third parties from accessing pockets located on the outside of the briefcase, backpack or suitcase; and (ii) a system of self-adjusting shoulder straps that allows for equal and automatic distribution, on both users shoulders, of the weight or load contained in the object intended for storage such as a briefcase, backpack or suitcase, ensuring the weight is perfectly balanced and ergonomically adapted to the user's back.

TECHNOLOGY SECTOR

This invention may be classified as part of the sector of the manufacture industry, specifically in the textile and/or leather goods (accessories) sector. It corresponds to the making and marketing of sacks or packages carried on the body by means of two straps that pass over both shoulders (suitcases, briefcases and/or backpacks).

INVENTION BACKGROUND

Self-Adjusting Strap System

Most traditional objects designed to keep elements such as briefcases, backpacks or rucksacks usually require users to adjust straps manually so that the weight is balanced and the sack adapts properly when they hang it their backs. It also happens that users may have to put some of these objects on the floor to adjust the height of straps to their size; or take them off to remove the straps and store them inside the object. As a matter of fact, the self-adjusting strap system, subject of this invention, gets rid of the problem of users having one strap longer than the other when putting on the object intended to store elements. Thus, it removes the discomfort of adjusting each strap manually and independently and the feeling of unevenly distributed weight.

Document PCT/FR2011/050397 specifically seeks to implement a hiking rucksack equipped with adjustable shoulder straps to fit each user's morphology and optimize the adjustment of the shoulder straps. This refers to both the height adjustment of the position of the straps in relation to the rear face on which the sliders are mounted and the fitting of the straps around the users shoulders. Thus, there is optimization of strap adjustment on the backpack to keep it on the back. However, this system is exclusive for hiking rucksacks and it still requires some manual adjustment by the user.

Additionally, European document EP 1 484 996 B1 deals with a device to adjust the position to carry a backpack. It has a harness that comprises two manual means to control and adjust the position established with the help of remote manual controls. They are autonomous from each other, and they allow adjusting the position of the backrest of the backpack in relation to the carrying harness. Thus, the first device allows raising the backrest of the backpack in relation to backrest and harness; and the second mechanism allows lowering the backside of the backpack in relation to the harness so that the size of the backside of the backpack may be adjusted to the person who is carrying it.

Similarly, European document EP1457131 B1 introduces a load carrying and adjustment device, which has two control units to regulate the position of the rear structure of the backpack. It consists of a harness and a strap that moves the structure. A mechanism locks or unlocks the strap in position. The unit has a strap with one end integrated into it and into the equipment, and the other end provides a control lever.

As explained, the above inventions differ from the proposal herein in the sense that the adjustment of the position of backpacks takes place thanks to the harness, which must be operated manually by users. Additionally, these devices are especially used in large capacity rucksacks such as the type generally used in hiking and mountain climbing.

Moreover, European document FR2677235 explains a device to adjust a backpack, at an appropriate level, by using an element that slides along a linear guide that is securely fixed to a support. The sliding element is firmly attached, on the one hand, to a strap that exerts a pulling action on this sliding element, and, on the other hand, to a strap of adjustable length that is resistant to the foresaid pulling action. The characteristic of the device is that the sliding element is mounted on the linear guide so that it can move on the free face of the belt and it includes at least two lateral returning branches.

The latter invention differs from the proposal herein in the fact that the adjustment takes place by means of a sliding element attached to a fixed linear guide, which must be manually operated by the user in order to achieve adjustment of the backpack at a suitable level.

Finally, European document EP0122764 describes a device to adjust the distance between the shoulder blade pads and the lumbar pad, so that the backpack may fit comfortably on users of different torso lengths. The scapular pads are mounted on a cross plate that slides into the vertical frame members. The position of the shoulder blade pad may be adjusted continuously and also quickly, while the backpack is actually on the user's back. Optional dependent straps make it easy for users to adjust them. The position of the pads on the hip belt can also be adjusted to suit users of different physical complexion.

As a matter of fact, this device is a system that allows the backpack to be lowered or raised based on an internal system located on the rear side of the backpack, between the lower back (lumbar) and shoulder pads. In other words, the adjustment is not achieved by balancing the weight of the backpack on both shoulders, but by allowing the position of the backpack to change in relation to the length of the user's back (torso). It is also evident that this change of position is not achieved through the adjustment of the shoulder pads or straps of the backpack in an automatic fashion, as it is the case in the proposed invention. Finally, the above-mentioned mechanism is exclusively found in high capacity rucksacks such as the type used in sports like hiking and mountaineering.

Rear Anti-Theft Protection Mechanism with Magnetic Opening

On the other hand, since a great deal of the pockets with or without zippers of the objects intended for storage such as briefcases, backpacks or suitcases are usually located on the top or front (external) part of such items, the insecurity of elements kept inside turns out to be very high since they may be easily accessed by third parties.

Some existing briefcases, backpacks or suitcases have tried to solve the problem of insecurity through hidden pockets, padlocks over the holes of the closures, alarm systems, and even a rear opening system instead of a front one. However, there is not any independent protection magnet-based mechanism in the state of the art, which may be applied to any object designed to store elements such as briefcases, backpacks or suitcases. Therefore, it is necessary to found out about current products or granted patents, whether they have the presence of protection mechanisms effectively incorporated into briefcases, backpacks or rucksacks and compare them to this invention.

From this view point, document U.S. Ser. No. 09/634,278 introduces a personal security backpack that emits audio alarm signals powered by a portable battery to attract attention. Two shoulder straps and a large main compartment for personal items are provided. The alarm system is hidden under an openable access flap that covers the entire component compartment. Two siren signal generators are placed inside the backpack near the openings to create a loud, distinguishable noise with unsilenced sirens pointing in opposite directions. This is then a personal security backpack with a pair of straps adapted for user transport on the back, an audible alarm system and a compartment where personal items may be carried. Thus, it is evident that this invention does not have a magnetic safety mechanism, but its protection system is based on audio alarm signals.

Similarly, paper CN202552602 U presents as an invention a backpack with a zipper on the backside made from resistant materials. This zipper does not allow third party access to the elements inside the backpack, as it is sealed with a padlock and it is located at the rear side of the backpack. Although access to the contents of the backpack is from the rear side, the protection system relies exclusively on the padlock that seals the zipper.

Document US20110031294 A1 describes an anti-theft backpack with a localizer and has a lockable flap to secure the contents of the bag. It provides a locking localizer to secure the flap and prevent accidental opening of the bag. The locking localizer also contains a GPS component, which allows the user to track the backpack if it is stolen or lost. The position of the bag is displayed in real time on a device with Internet access. This invention indeed differs substantially from the proposed invention in as much as the protection systems are different. The former type contains a GPS component for localization, and magnet-based security mechanisms are not included at all.

Finally, it is paper CN103876437 A, which presents an anti-theft backpack with a zipper closure made up of zip lines, and an encryption lock placed before the zipper to control the sliding. The encryption lock on the anti-theft backpack may prevent the zipper closure from unzipping and the high-performance fiber fabric may prevent damage to the backpack. Hence, it is clear that the protection method of this invention is designed based on an encryption lock system, which does not have any similarity to the security system claimed by the patent application herein.

In conclusion, it is proven that none of the aforementioned inventions has a rear protection mechanism with magnetic opening nor a self-adjusting straps system, which may be used in an object designed to store elements such as a briefcase, backpack or rucksack.

INVENTION DISCLOSURE

The invention disclosure made during the grace year was carried out digitally through the following web sites:

INDIEGOGO:

Fundraising campaign carried out as of Oct. 23, 2017, which disclosed the invention under the commercial name 'SPEED BACKPACK' on the website www.indiegogo.com. The disclosure may be found at the following link https://www.indiegogo.com/projects/the-seed-backpack-the-only-bag-you-ll-ever-need#/.

YOUTUBE:

- A video that describes the functionalities of the invention, commercially called 'SPEED BACKPACK', published on Oct. 18, 2017, which is available at the link https://www.youtube.com/watch?v=41e53FQnQiA
- A video that describes the functionalities of the invention, commercially called 'SPEED BACKPACK', published on Oct. 22, 2017, which is available at the link https://www.youtube.com/watch?v=SwlOzSzOq38&t=115s
- A video that describes the functionalities of the invention (storage capacity), commercially called 'SPEED BACKPACK', published on Nov. 20, 2017, which is available at the following links: https://www.youtube.com/watch?v=0d8T0D4TRP0 and https://www.youtube.com/watch?v=sbpholNzpes.

BRIEF DESCRIPTION OF THE INVENTION

It may be described as (i) a rear protection mechanism with magnetic opening for items intended for storage such as briefcases, backpacks or suitcases, which acts as an anti-theft system for rear, side and/or lower pockets. The rear magnetic opening mechanism (located against the user's body) is made up of flaps with non-visible magnets located inside them, which, at contact with other magnets located on the rear face of the object, generate an attraction effect that secures the flaps in such a way that it prevents third parties from accessing pockets located on the outside of the briefcase, backpack or suitcase; and (ii) a system of self-adjusting shoulder straps that allows for equal and automatic distribution, on both users shoulders, of the weight or load contained in the object intended for storage such as a briefcase, backpack or suitcase, ensuring the weight is perfectly balanced and ergonomically adapted to the user's back.

FIGURE DESCRIPTION

To understand the invention more thoroughly, the graph of a backpack will be used as an example of an object designed to store elements. The rear magnetic-opening mechanism and the self-adjusting straps system are installed in the backpack.

Figure 6:
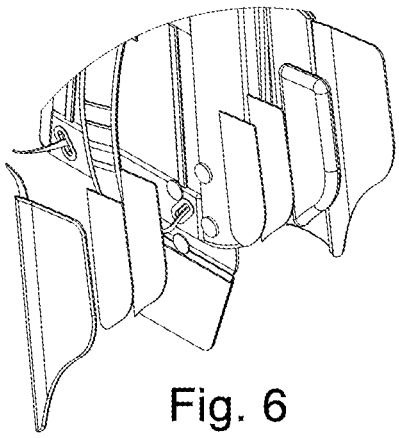

FIG. 6 zooms in on the partially expanded view of the magnetic mechanism of a side flap.

Figure 7:
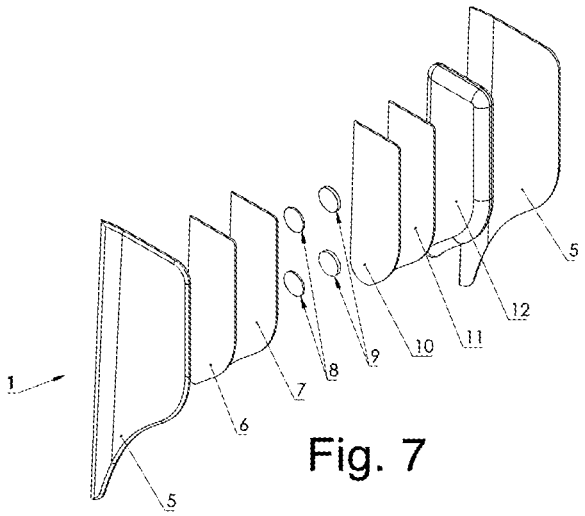

FIG. 7 zooms in on the internal components of the magnetic mechanism of a side flap from an expanded view.

Figure 8:
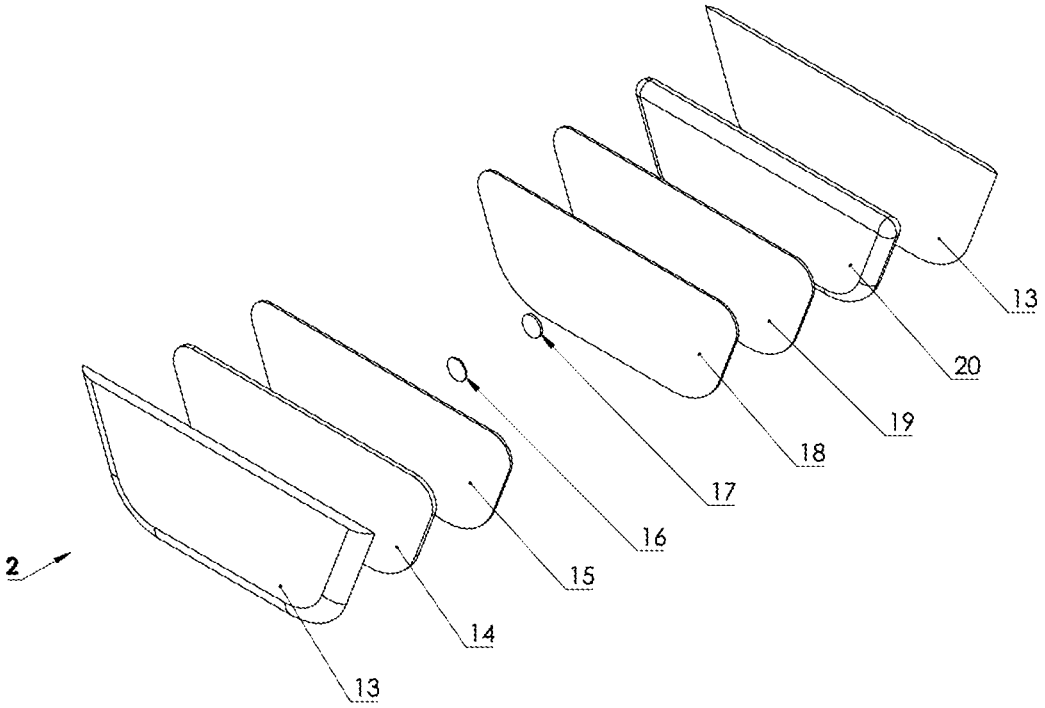

FIG. 8 zooms in on the internal components of the magnetic mechanism of the lower flap from an expanded view.

Figure 9:
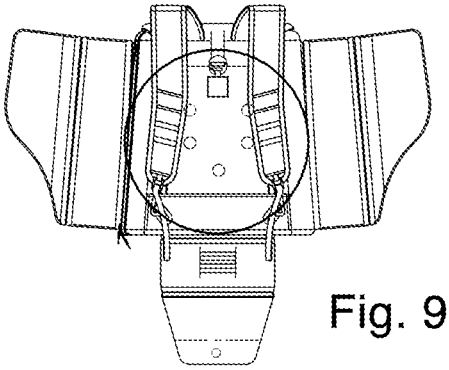

FIG. 9 shows the back side of the backpack with the rear magnetic-opening mechanism deployed and with a focus on the magnet mechanism located on the back of the backpack.

Figure 10:
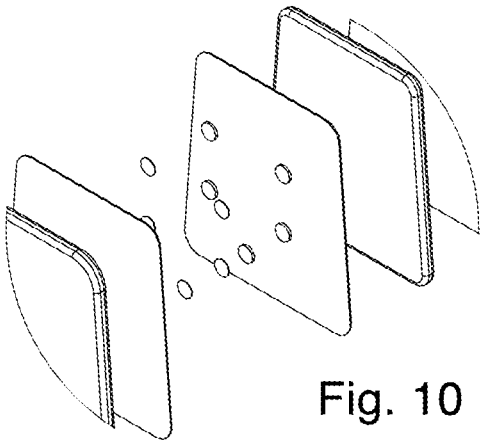

FIG. 10 zooms in on the partially expanded view of the magnetic mechanism located inside the backpack.

Figure 11:
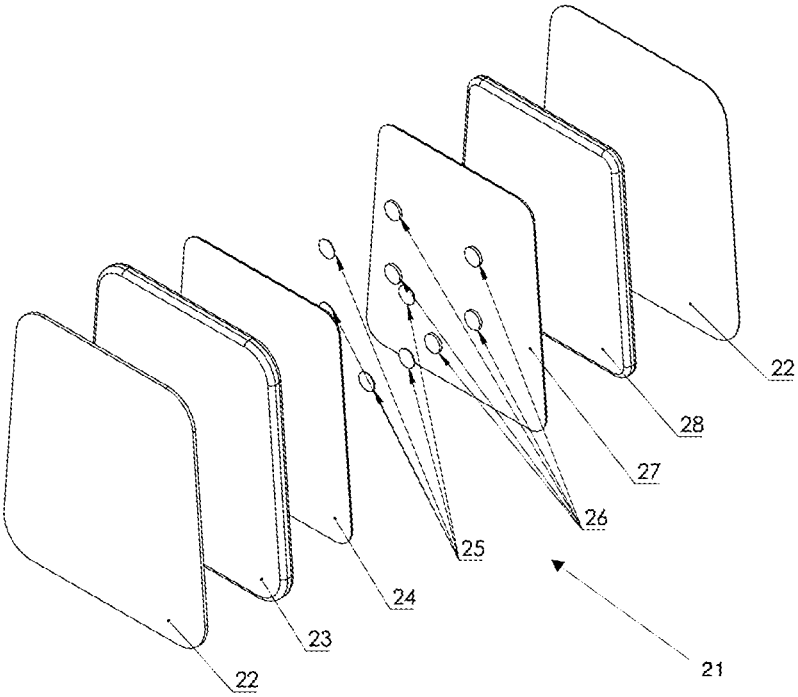

FIG. 11 zooms in on the internal components of the magnetic mechanism located on the back of the backpack from an expanded view.

Figure 12:
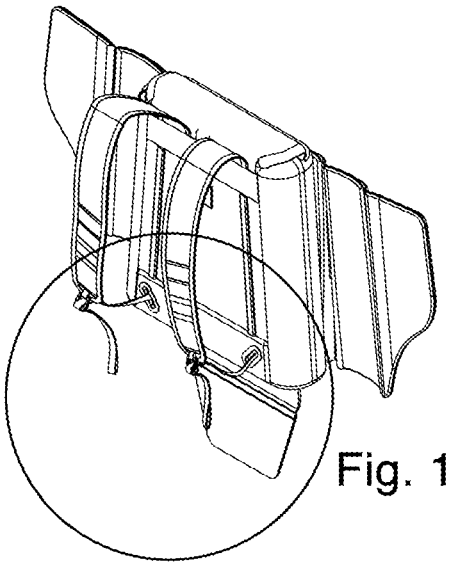

FIG. 12 shows the back side of the backpack from a diagonal view with the rear magnetic-opening mechanism deployed and with a focus on the self-adjusting shoulder strap system.

Figure 13:
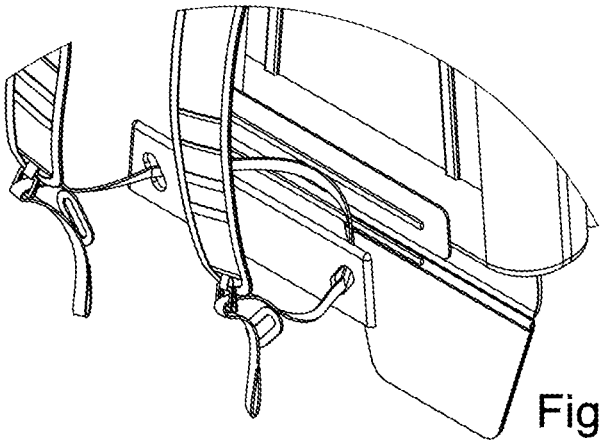

FIG. 13 zooms in on the partially expanded view of the self-adjusting shoulder strap system located at the back and bottom of the backpack.

Figure 14:
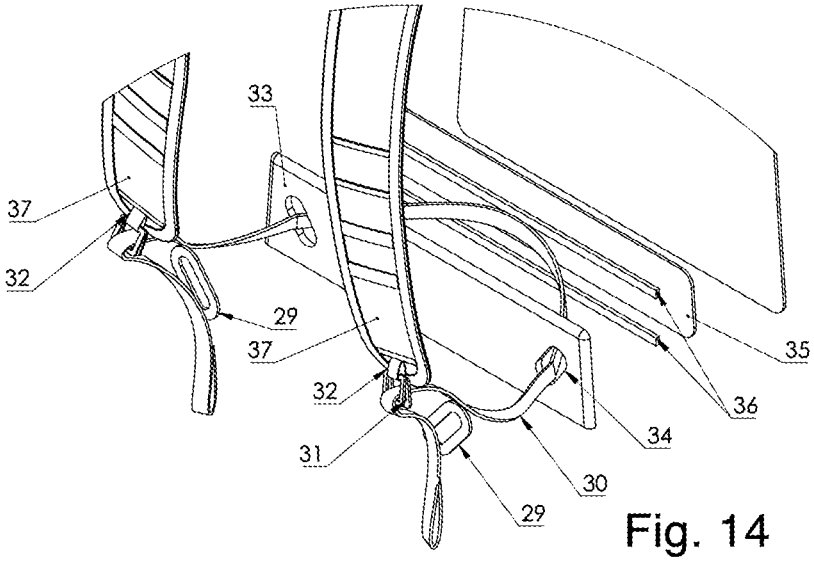

FIG. 14 zooms in on the components of the self-adjusting strap system from an expanded view.

DETAILED DESCRIPTION OF THE INVENTION

Rear Anti-Theft Protection Mechanism with Magnetic Opening

The rear magnetic-opening mechanism comprises three main elements (a) two side flaps (1), and a lower one (2), (b) a backrest (3) and (c) two safety bars (4).

Figure 1:
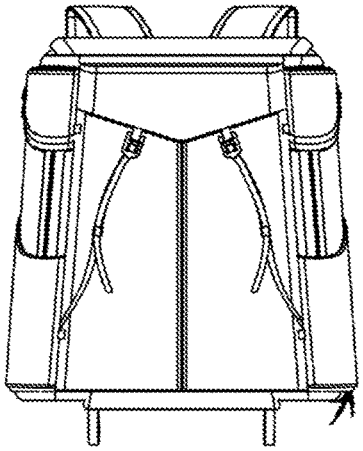
FIG. 1 shows the front side of the backpack.
Figure 2:
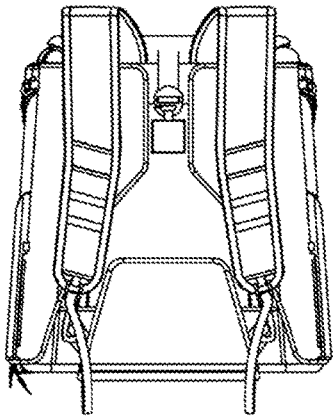
FIG. 2 shows the back side of the backpack.
Figure 3:
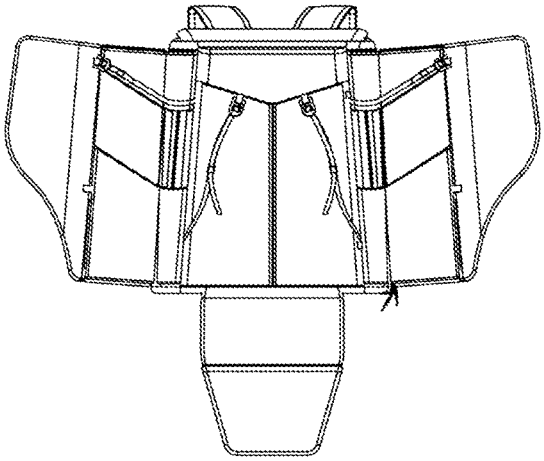
FIG. 3 shows the front side of the backpack with the rear magnetic-opening mechanism deployed.
Figure 4:
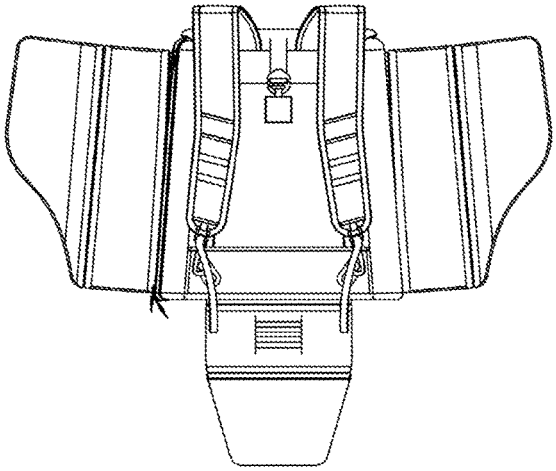
FIG. 4 shows the back side of the backpack with the rear magnetic-opening mechanism deployed.
Figure 5:
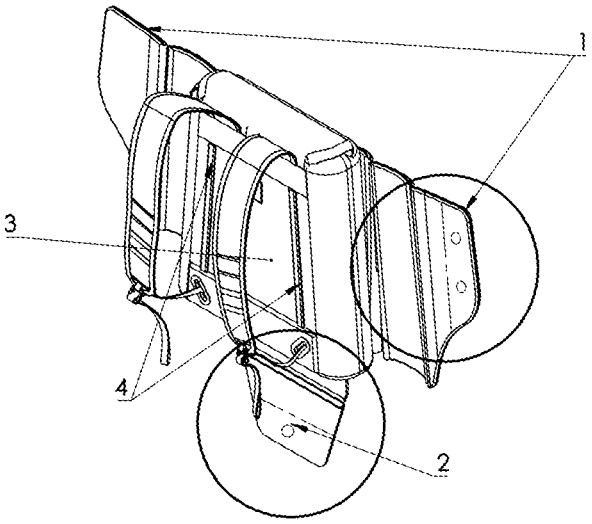
FIG. 5 shows the back side of the backpack from a diagonal view with the rear magnetic-opening mechanism deployed and with a focus on one of the side flaps and the bottom flap.

Each side flap (1) (FIGS. 5, 6 and 7) comprises a layer of fabric (5), a salpa film (6), a polymer panel (7) with two holes (8), two magnets (9), a tin plate (10), a polymer panel (11) and a foam panel (12). Thus, there are two magnets (9) in the center of each flap (1), which are located between a polymer panel (7) attached to a salpa film (6) and a tin plate (10). The polymer panel (7) has two holes (8) to place the magnets (9) in it. The two holes (8) are located vertically and parallel to each other. Once the magnets (9) are placed into the holes (8), the polymer panel (7) and the tin plate (10) are joined together by clamping them so that the magnets (9) do not move. Adjacent to the tin plate (10), there is another polymer panel (11) and a foam panel (12). At the end, all the above elements are covered by a layer of outer fabric (5) and forming a side flap (1).

This description applies equally to both side flaps (1) (right and left).

On the other side, in front of the lower flap (2) (FIG. 8), there is a layer of fabric (13), a salpa film (14), a polymer panel (15) with a hole (16), a magnet (17), a tin plate (18), a polymer panel (19) and a foam panel (20). Thus, there is a magnet (17) in the center of the lower flap (2). It is located between a polymer panel (15) attached to a salpa film (14) and a tin plate (18). The polymer panel (19) has a hole (16) to place the magnet (17) in it. This hole (16) is located in the center and at the bottom of the bottom flap (2). Once the magnet (17) is place in this hole (16), the polymer panel (15) and the tin plate (18) are joined by clamping so that the magnet (17) does not move. Adjacent to the tin plate (18), there is another polymer panel (19) and a foam panel (20). At the end, all the above elements are covered by a layer of outer fabric (13), forming a bottom flap (2).

The side flaps (1) and the bottom flap (2) are attached by seams to the body of the backpack, in the side and bottom areas.

In other instances, the rear anti-theft protection mechanism may be composed of a single, two or four flaps.

In other instances, the flaps of the rear anti-theft protection mechanism may be located on top of the object designed to store elements.

In another instance, the flaps of the rear anti-theft protection mechanism have internal pockets to store elements.

In other instances, each flap of the rear anti-theft protection mechanism may have more or fewer than two (2) magnets.

The back side (21) (FIGS. 9, 10 and 11) contains a layer of fabric (22), an EVA rubber panel (23) attached to a polymer panel (24) with five holes (25), five magnets (26), a tin plate (27), an EVA rubber panel (28) and two polymer safety bars (4). Thus, inside the backside (21), there are five magnets (26) distributed as follows: two magnets located on the upper left side edge of the backside (21) of the backpack, and parallel to each other. The other two magnets are located on the upper right-side edge of the backside (21) of the backpack, and they are parallel to each other. The last magnet is located in the lower central part of the backside (21) of the backpack. The safety bars (4) are located on the edges of each end of the backside (21) of the backpack and in parallel position, so that the magnets (26) are in the middle of both bars (4).

Inside the backside (21), there are the five magnets (26) in the locations explained above. These magnets (26) are incorporated into a polymer panel (24), which is attached to another EVA rubber panel (23). The magnets (26) are incorporated into the polymer panel (24) through holes (25) made in it. Once the magnets (26) are placed into the holes (25), the polymer panel (24) is attached to a tin plate (27), clamping the magnets (26) so that they do not move. Adjacent to the tin plate (27), there is another EVA rubber panel (28). At the end, all the above elements are covered by a layer of outer fabric (22).

In another instance, the backside of the rear anti-theft protection mechanism may be equipped with more or fewer than five (5) magnets.

Taking into account the abovementioned elements, it occurs that the anti-theft protection mechanism works when the user joins, by means of the attraction of the magnets, the two side flaps (1) and the lower flap (2) to the backside (21) of the backpack. The safety bars (4) help the flaps (1-2) not slide sideways and be fixed to the backside (21). Thus, all the access pockets of the backpack are covered by the three flaps (1-2), which means that no third party may access them from the outside of the backpack.

Self-Adjusting Strap System.

The self-adjusting strap system (FIGS. 12, 13, and 14) includes two oval aluminum, brass, or steel grommets (29), a nylon or polyester fabric strap (30), two double aluminum, brass, or steel pins (31), two fabric connectors (32), a polymer panel (33) with two oval holes (34) on each end, a polymer panel (35), and two polymer bars (36).

In one instance the double pins (31) are made of aluminum. In another instance, they are made of steel and in another instance, they are made of brass. Double pins are preferably made of aluminum.

In one instance, the strap (30) is made of nylon material. In another instance, it is made of polyester. The strap is preferably made of nylon material.

At the bottom of one of the shoulder pads (37) of the backpack, there is a fabric connector (32) that holds a double pin (31). The strap (30) goes through the pin (31), and it is inserted into one of the grommets (29), and passes through a hole (34) in the polymer panel (33), surrounding it at the back and coming out through the hole (34) at the other end of the panel (33) and inserting again into the other grommet (29) and crossing through the double pin (31) of the other shoulder strap (37). Between the polymer panel with oval holes (33) and the other polymer panel (35), there are two horizontal polymer bars (36), parallel to each other, which create a space between the two panels, so that they may allow the strap (30) to circulate easily and without friction.

In fact, having a single continuous strap (30) joining the two shoulder pads (37) of the backpack, through a system that acts as a pulley, achieves continuous tension between the straps, which creates an automatic balance of the load in the backpack.

In one instance, the object intended to store items such as a briefcase, backpack or suitcase only has the rear anti-theft protection mechanism with magnetic opening.

In another instance, the object designed to store elements such as a briefcase, backpack or suitcase only has the self-adjusting straps system.

The invention claimed is:

1. A rear magnetic-opening anti-theft protection mechanism comprising:

two side flaps having side flap internal magnets, a lower flap having lower flap internal magnets, the side flap internal magnets and lower flap internal magnets are adhered to a body of a backpack by means of seams in a lateral area or a lower area of the body of the backpack;

backside internal magnets, wherein the side flap internal magnets and the lower flap internal magnets close the backpack from a backside of the body of the backpack;

two safety bars attached to the backside of the backpack, wherein the two safety bars prevent the two side flaps and the lower flap from sliding, thereby fixing the two side flaps and the lower flap to the body of the backpack;

wherein each of the two side flaps have:

i) a first polymer panel having holes, the first polymer panel located between a salpa film, and a tin plate, wherein the side flap internal magnets are located inside the holes of the first polymer panel, ii) a second polymer panel and a foam panel adjacent to the tin plate, and, iii) an outer layer of fabric covering the first polymer panel, the second polymer panel, the salpa film, and the tin plate, to form each of the two side flaps.

* * * * *